US005682696A

United States Patent [19]

Gill

[11] Patent Number: 5,682,696

[45] Date of Patent: Nov. 4, 1997

[54] SIGNAGE AND METHOD OF MANUFACTURING SAME

[75] Inventor: Forrest P. Gill, Shawnee Mission, Kans.

[73] Assignee: Gill Studios, Inc., Shawnee Mission, Kans.

[21] Appl. No.: 633,906

[22] Filed: Apr. 17, 1996

Related U.S. Application Data

[63] Continuation-in-part of Ser. No. 268,844, Jun. 30, 1994, abandoned.

[51] Int. Cl.[6] ..... G09F 15/00

[52] U.S. Cl. ..... 40/606; 248/156

[58] Field of Search ..... 40/606, 607; 248/156, 248/530, 545

[56] References Cited

U.S. PATENT DOCUMENTS

| | | | |
|---|---|---|---|
| 3,217,437 | 11/1965 | Cobb | 40/607 X |
| 4,660,310 | 4/1987 | Farmer | 40/607 |
| 4,885,860 | 12/1989 | Huenefeld | 40/606 |
| 4,894,937 | 1/1990 | Davis | 40/606 |
| 5,042,183 | 8/1991 | Kennedy | 248/156 X |
| 5,247,769 | 9/1993 | Becker . | |
| 5,307,580 | 5/1994 | Farmer | 248/156 X |

*Primary Examiner*—Joanne Silbermann

*Attorney, Agent, or Firm*—Litman, McMahon & Brown, L.L.C.

[57] ABSTRACT

A sign assembly includes a sign and a bent wire bail for ground insertion. The sign is formed from a blank with adhesive strips for securing its inner surface together in a folded position. A sign mounted on a wooden stick is shown as an alternative embodiment. A method of manufacturing the sign mounted on a wooden stick involves placing inner and outer parallel strips of adhesive on the inside faces of a sign blank and folding the sign blank together to provide a pocket between the innermost adhesive strips. A wooden stick is inserted into the pocket.

1 Claim, 3 Drawing Sheets

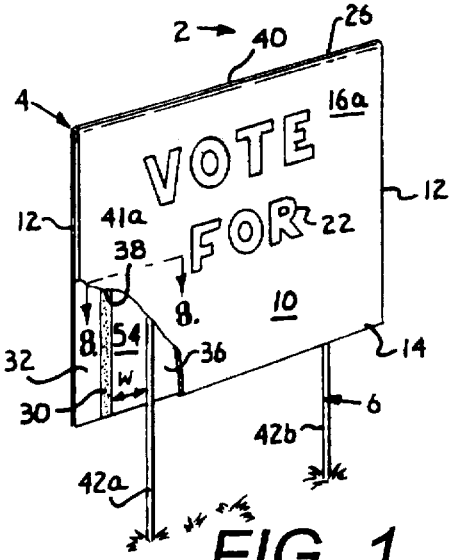
FIG. 1
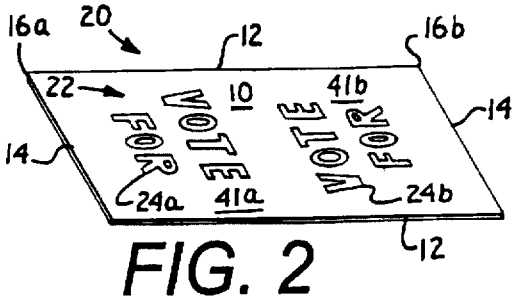
FIG. 2
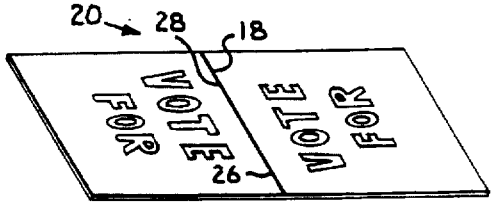
FIG. 3
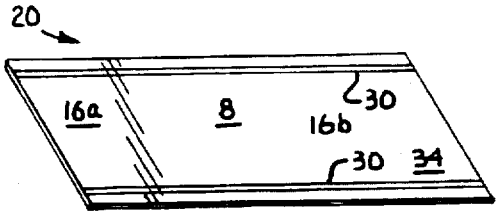
FIG. 4
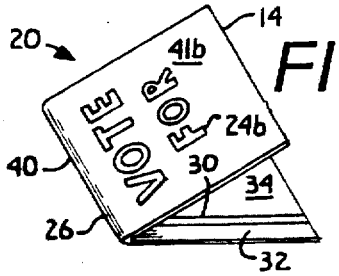
FIG. 5
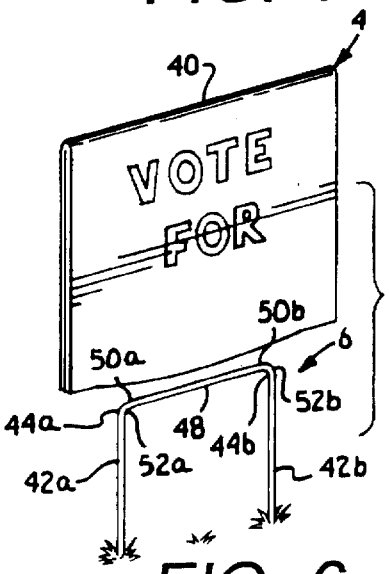
FIG. 6
FIG. 7
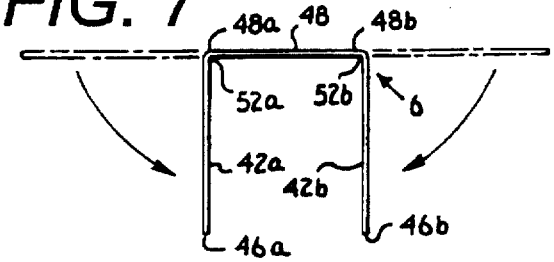
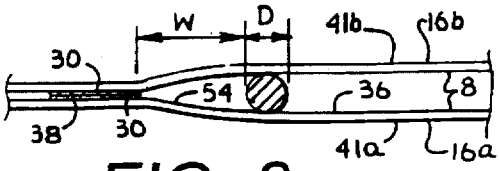
FIG. 8

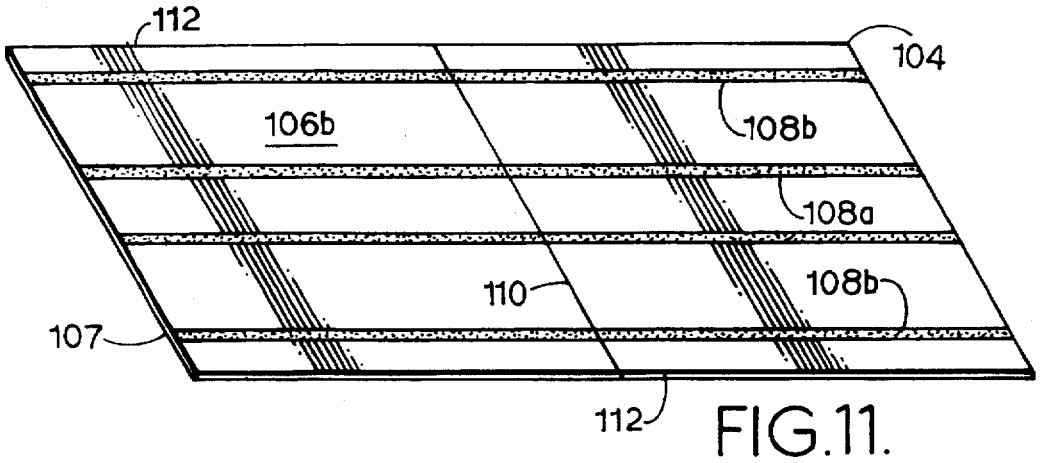
FIG.11.
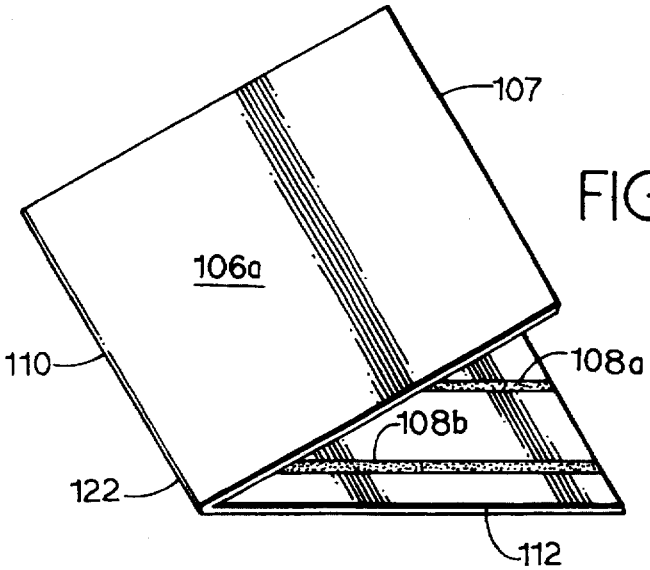
FIG.12.
FIG.13.
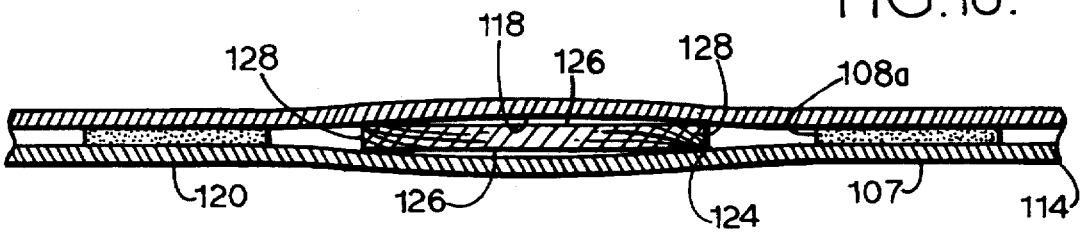

SIGNAGE AND METHOD OF MANUFACTURING SAME

CROSS-REFERENCE TO RELATED APPLICATION

This application is a continuation-in-part of application for U.S. patent Ser. No. 08/268,844 for TWO-SIDED YARD SIGN AND METHOD OF MANUFACTURING SAME, filed Jun. 30, 1994 now abandoned.

BACKGROUND OF THE INVENTION

1. Field of the Invention

The present invention relates generally to signage, and in particular to a two-sided yard sign with adhesively connected to halves or panels forming a pocket to receive a wire bail in frictional engagement therewith.

2. Description of the Related Art

Various types of signage have heretofore been devised to meet the requirements of particular applications. Resistance to the elements can be an important factor in exterior signage. Temporary signage generally requires some ability to resist the elements, but for shorter time periods than permanent exterior signage.

Examples of temporary exterior signage include signs promoting political candidates, signs advertising particular events, and commercial signage such as signs which offer property for sale or lease. be kept as low as possible so that the maximum number of signs can be procured with a given amount of funds. Other important factors for political and advertising signage include sign blanks consisting of single panels printed on both sides and attached to wooden mounting stakes. However, such stakes tend to obscure at least a portion of one side of the single panel and moreover complicate assembly since the stakes must be driven and the signs attached thereto, generally with mechanical fastening means such as staples or nails.

Another type of temporary signage which is commonly used for political and commercial purposes consists of a sign blank printed on one side with mirror, reverse image subject matter on both halves and provided with a medial fold line for displaying the same image on both sides when the sign blank is folded double. The side edges of such previous two-sided signs were commonly stapled to form downwardly-open pockets between the sign panels. Such signs could be installed by providing wire bails with inverted U-shaped configurations which were driven into the ground and then partly inserted into the sign pocket for mounting same. Such previous signage suffered a disadvantage in that the stapling of the side edges was not readily accomplished with existing automated equipment for printing and folding signs, and tended to slow the assembly and installation of signage in the field. Thus, stapling the folded sign blanks tended to either add to the expense of manufacturing such signage, or if left to the field installer tended to increase the labor required for field assembly and installation.

Automated equipment is commercially available for cutting, printing, folding and gluing various products from sheet materials. For example, containers such as boxes and envelopes are often manufactured using automated equipment for cutting blanks from paper and card stock, printing selected surfaces and panels, folding the printed blank and adhesively connecting certain panels at adhesive seams to provide the necessary pockets, enclosures, etc. Such equipment is highly developed in the envelope manufacturing field and is capable of automatically manufacturing large quantities of envelopes and similar products at relatively rapid rates.

Heretofore such automated manufacturing equipment has not been used in the production of signage with the advantages and features of the present invention.

SUMMARY OF THE INVENTION

In the practice of the present invention, a two-sided yard sign assembly is provided which includes a sign and a bail for mounting the sign thereon. The sign is formed from a blank including inner and outer surfaces and is divided into two halves or panels by a medial, scored fold line. Each panel is printed with subject matter on the blank outer surface. The subject matter on each panel can be a reverse, mirror image of the subject matter on the other panel whereby both sides of the folded sign present the same image. A pair of adhesive strips are applied to the sign inner surface in parallel relation with respect to side edges thereof and form side seams when the sign blank is folded. The wire bail has an inverted U-shaped configuration and is adapted for driving into the ground and for insertion into a pocket formed by the sign blank.

In the practice of the method of the present invention, automated equipment is utilized for printing, scoring and folding the sign blank, and for applying the adhesive strips thereto. The wire bail can be bent from a length of wire to its desired configuration.

OBJECTS AND ADVANTAGES OF THE INVENTION

The principal objects and advantages of the present invention include: providing a two-sided yard sign assembly; providing such a sign assembly which can be manufactured with automated equipment; providing such a sign assembly which has a sign blank with printing on an exterior surface thereof and which is folded and glued to form a two-sided sign with a downwardly-open pocket; providing such a sign assembly which can be frictionally mounted on a wire bail; providing such a sign assembly which is relatively inexpensive to manufacture; providing such a sign assembly which is relatively easy to assemble; providing such a sign assembly which can be manufactured for a relatively low cost; providing such a sign assembly with good aesthetic qualities; providing such a sign assembly which presents a uniform appearance from both sides; and providing such a sign assembly which is particularly well adapted for temporary usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a two-sided yard sign assembly embodying the present invention.

FIG. 2 is a perspective view of a blank thereof, particularly showing an outer surface thereof. FIG. 3 is a perspective view of the blank, particularly showing an outer surface thereof.

FIG. 4 is a perspective view of the blank, particularly showing an inner surface thereof.

FIG. 5 is a perspective view of the blank, shown being folded.

FIG. 6 is an exploded perspective view thereof.

FIG. 7 is an elevational view of a wire bail thereof.

FIG. 8 is a horizontal cross-sectional view thereof taken generally along line 8—8 in FIG. 1.

FIG. 11 is a perspective view of a sign blank thereof in its unfolded configuration.

FIG. 12 is a perspective view of the sign blank being folded.

FIG. 13 is an enlarged, fragmentary, cross-sectional view of the stick-mounted sign assembly taken generally along line 13—13 in FIG. 9.

DETAILED DESCRIPTION OF THE PREFERRED EMBODIMENTS

I. Introduction and Environment

Figure 9:
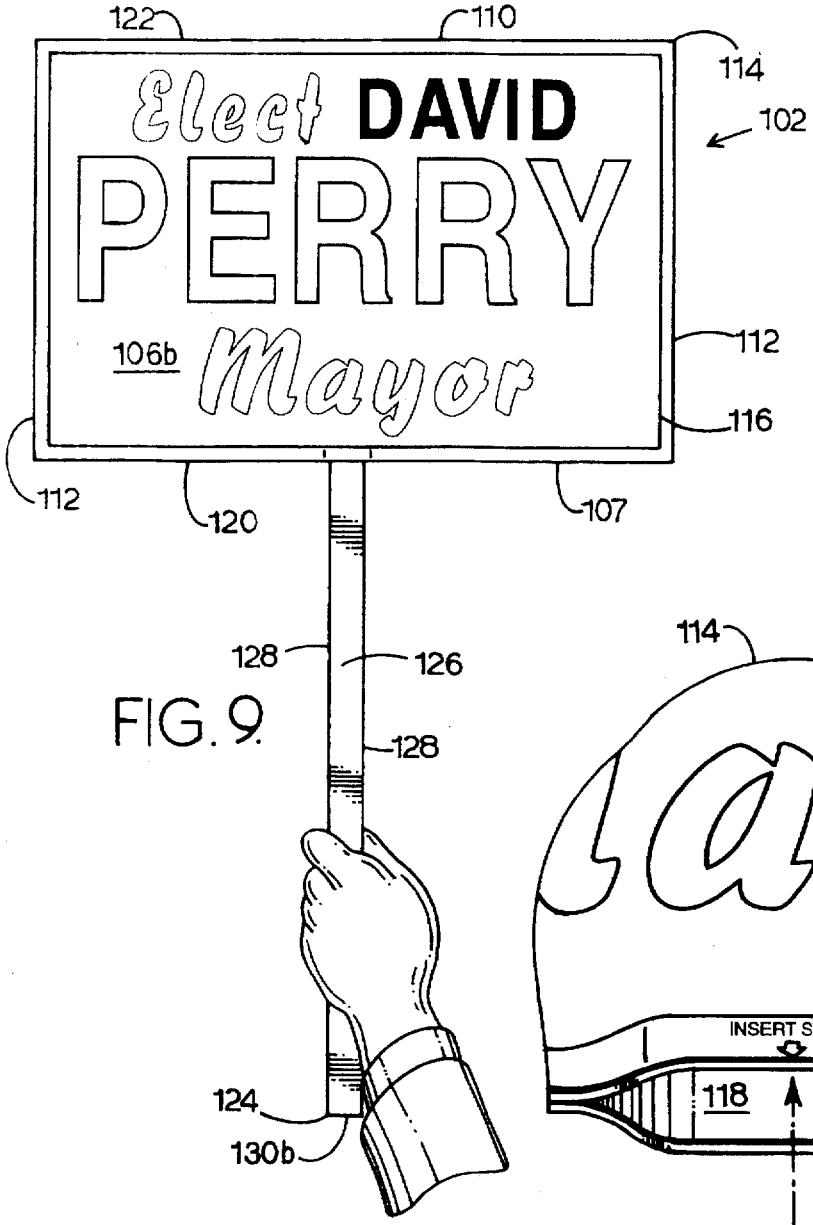
FIG. 9 is a front elevational view of a stick-mounted sign assembly comprising a first modified or alternative embodiment of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a two-sided yard sign assembly embodying the present invention. The sign assembly 2 generally comprises a sign 4 and a bail 6.

II. Sign 4

The sign 4 can comprise any suitable, printable material such as card stock. The sign 4 includes: inner and outer surfaces 8, 10; opposite, parallel side edges 12; opposite end edges 14; and first and second halves 16*a*, 16*b* demarcated by a medial line 18 extending between said side edges 12 in parallel, spaced relation generally midway between the end edges 14. A sign blank 20 is formed as shown in FIG. 2 with a generally, flat, rectangular configuration. Suitable printing 22 is applied to the sign blank outer surface 10 and can comprise identical subject matter printed as reverse, mirror images 24*a,b* on the respective sign blank halves 16*a*, 16*b*. The printing 22 can comprise any suitable ink or coating material, which preferably is sufficiently weatherproof for the ambient conditions to which the sign assembly 2 will be exposed. Waterproof and water-resistant inks and coatings are well known and can be utilized for applying the printing 22 for use in exterior environments. Moreover, a relatively high gloss finish may be preferred for the printing 22 for aesthetic purposes.

A score line 26 is formed along the medial line 18 in the sign blank outer surface 10 to facilitate folding. The printing 22 can include suitable center line markings 28 to locate the score line 26. A pair of adhesive strips 30 are applied to the sign blank inner surface 8 between the end edges 14 thereof and form unsecured edge portions 32 adjacent respective side edges 12 and an unsecured middle portion 34 bounded by the adhesive strips 30 and the end edges 14. With the sign blank 20 in its folded configuration, a pocket 36 is formed between the inner surface 8 of the sign blank halves 16*a*, 16*b* which is bounded by side seams 38 formed by the adhesively attached adhesive strips 30 and by a top edge 40 formed along the score line 26. The pocket 36 is downwardly open along the end edges 14 between the side seams 38.

III. Bail 6

The bail 6 includes first and second legs 42*a,b* with upper ends 44*a,b* and lower ends 46*a,b*. A bail cross piece 48 extends between the legs 42*a*, 42*b* and includes cross piece ends 50*a*, 50*b* respectively connected to the leg upper ends 44*a*, 44*b* at bail corners 52*a*, 52*b*. The bail 6 can comprise a single piece of a suitable material, such as steel wire, bent at the bail corners 52*a*, 52*b* to form the general configuration of an inverted "U".

IV. Manufacturing Method

A method of manufacturing the yard signage 2 includes the steps of cutting a rectangular sign blank 20 from a suitable material such as card stock, scoring the sign blank 20 along a medial line 18 to form a score line 26 and printing an outer surface 10 of the sign blank 20 with indicia or messages comprising reverse mirror images 24*a*, 24*b* on opposite sign blank halves 16*a*, 16*b*. The adhesive strips 30 are applied to the sign blank inner surface 8 in parallel, spaced relation with respect to the side edges 12 between the middle portion 34 and respective unsecured edges 32. The sign blank 20, with printing and adhesive applied thereto, is then folded along the score line 26, the respective opposed portions of the adhesive strips 30 engage each other along the side seams 38 and a downwardly open pocket 36 is formed.

The bail 6 can be cut from steel wire stock to a suitable length and bent to form the corners 52*a*, 52*b*.

Final assembly of the yard signage 2 can be accomplished either as part of the manufacturing process in situ when the signage 2 is installed. However, in many situations it would be more convenient to first install the bail 6 by embedding the lower ends 46*a*, 46*b* of its legs 42*a*, 42*b* in the ground, and then placing the sign 4 thereover by inserting the cross piece 48 and the leg upper ends 44*a*, 44*b* into the pocket 36 to a position where the cross piece 48 is in closely-spaced proximity to the sign top edge 40. An installer can thus grasp the bail 6 at its cross piece 48 to facilitate exerting a downward force on the bail 6 to force its legs 42*a*, 42*b* a sufficient distance into the ground. Moreover, installation of the bail 6 prior to placing the sign 4 can reduce the possibility of damage to the sign 4 which might otherwise might occur during installation. For example, if the sign 4 is mounted on the bail 6 prior to installation and the bail 6 buckles under downward pressure, the sign 4 could be torn. However, by placing the bail 6 prior to mounting the sign 4, the bail 6 can be straightened relatively easily if bent during installation, and an undamaged sign 4 can be mounted on a restraightened bail 6 without noticeably effecting the appearance of the completed signage 2.

The folded sign 4 cooperates with the bail 6 to provide a relatively secure frictional engagement therebetween without the necessity of additional fastening means under normal conditions. More specifically, the spacing of the seams 38 is slightly greater than the width of the bail 6 whereby compression spaces 54 are formed between the side seams 38 and respective bail legs 42*a*, 42*b*, which compression spaces 54 have widths W which have a predetermined ratio with respect to the diameter D of the legs 42*a*, 42*b*. Such ratio is preferably between 2:1 and 8:1 whereby insertion of the bail 6 into the pocket 36 forces the sign blank halves 16*a*, 16*b* to diverge across the compression spaces 54 and thus tightly clamp the bail 6. Such clamping force can be increased by reducing the width W of the compression spaces 54 and vice-versa. However, if the compression spaces 54 are too narrow (i.e., the W/D ratio is too low), the sign blank 20 can be creased in a manner which would reduce its frictional holding power and possibly form an unsightly crease in the sign blank outer surface 10. By properly preselecting the W/D ratio, taking into the account the nature of the material comprising the sign blank 20, a relatively tight, frictional engagement can be formed between the sign 4 and the bail 6 whereby the assembled signage 2 resists disassembly under typical ambient conditions, at least for the limited periods of time appropriate for temporary signage. The adhesive strips 30 can form relatively secure side seams 38 with the sign blank inner surface secured in relatively flat, coextensive engagement over substantially the entire inner surface 8 whereby the aforedescribed frictional holding power on the bail 6 can be maximized.

V. Modified Embodiment Stick-Mounted Sign Assembly 102

Figure 10:
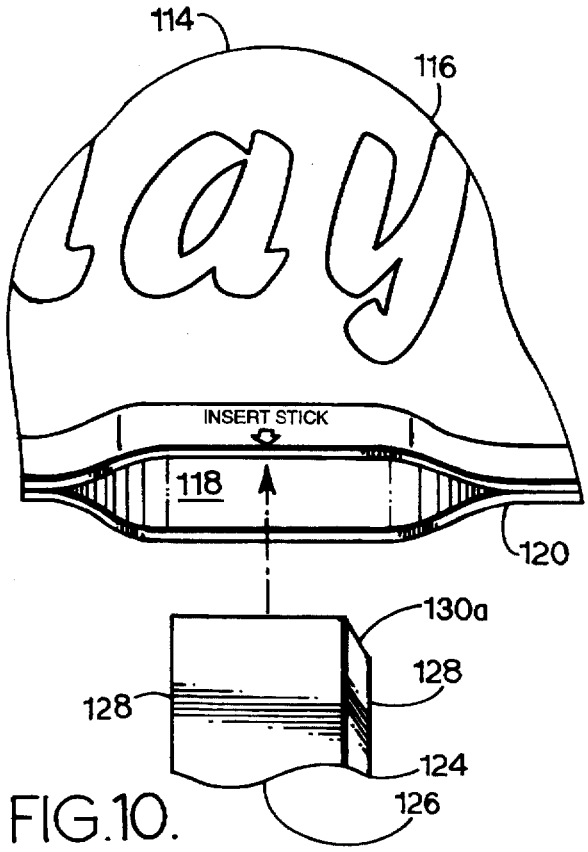
FIG. 10 is an enlarged, fragmentary, perspective view thereof.

A stick-mounted sign assembly 102 comprising a modified or alternative embodiment of the present invention is shown in FIGS. 9–13 and is generally designated by the reference numeral 102. The stick-mounted sign assembly 102 includes a sign blank 104 with inner and outer surfaces 106*a,b*, opposite ends 107 and inner and outer pairs of adhesive strips 108*a,b*. A fold line 110 extends medially across the sign blank 104.

As shown in FIG. 11, the outer adhesive strips 108*b* can be located in spaced relation inwardly from sign blank side edges 112, with the inner pair of adhesive strips 108*a* located in spaced relation inwardly from the outer pair of adhesive strips 108*b*. The adhesive strips 108*a,b* are located in generally parallel relation with respect to the side edges 112 whereby automated equipment can be used for applying the adhesive strips 108*a,b* to the sign blank inner surface 106*a*.

The sign blank 104 is folded along its medial fold line 110 to form a finished sign 114. Messages 116 in the form of promotional material, advertising, campaign slogans and the like can be printed on the sign blank outer surface 116*b*.

With the sign blank 104 folded to form the finished sign 114, a pocket 118 is formed between the inner pair of adhesive strips 108*a*. The pocket is open at adjacent, lower edges 120 of the sign 114 and extends to an upper edge 122 of the sign 114, which is located at the fold line 110.

The stick-mounted sign assembly 102 includes a stick 124 with faces 126, edges 128 and upper and lower ends 130*a,b*. The stick 124 is inserted in the pocket 118 with its upper end 130*a* located within the pocket 118 and its faces 126 engaged by the sign blank inner surface 106*a*. The stick edges 128 are positioned in proximity to the inner adhesive strips 108*a*. The resiliency of the sign blank 104 tends to frictionally grip the stick 124, particularly adjacent to the edges 128 as shown in FIG. 13. The stick 124 is thus relatively securely, but removably, mounted on the stick 124.

A method of manufacturing the stick-mounted sign assembly 102 is similar to the method described in connection with the two-sided yard sign assembly 2, except that two pairs of adhesive strips 108*a,b* are provided and the stick 124 is inserted in the finished sign 114. It will be appreciated that in lieu of a stick 124 with a blunt lower end 130*b*, a stick with a sharpened lower end could be provided for ground insertion whereby the stick-mounted sign assembly 102 could be used as a yard sign or the like.

It is to be understood that while certain forms of the present invention have been illustrated and described herein, it is not to be limited to the specific forms or arrangement of parts described and shown.

What is claimed and desired to be secured by Letters Patent is as follows:

1. A sign assembly, which includes:

(a) a sign comprising a sign blank with inner and outer surfaces, opposite side edges, opposites end edges, opposite halves and a medial fold line separating said halves;

(b) a pair of adhesive side seams securing said sign halves together at said inner surface, each said side seam extending in generally parallel relation with respect to a respective side edge;

(c) said sign forming a top edge along said medial fold line with said sign halves folded with respect to each other;

(d) said sign forming a pocket between the inner surface of said sign halves, said pocket being bounded by said side seams and said top edge and between said end edges;

(e) a bail including a pair of legs each having upper and lower ends and a generally straight crosspieces with opposite ends, said crosspiece opposite ends being attached to said leg upper ends, said leg upper ends and said crosspiece being received and frictionally retained in said sign pocket with said crosspiece thereof adjacent to said medial fold line within said pocket, said bail being formed from a continuous length of steel wire bent at substantially right angles to form the intersections of said leg upper ends and respective crosspiece opposite ends;

(f) said sign halves being printed with reverse, mirror image subject matter on said sign outer surface;

(g) said bail having a width less than a width of said pocket;

(h) a score line extending between said side edges and located midway between said end edges of said sign blank along said medial fold line thereof, said score line being located at a top edge of said folded sign on the outer surface thereof;

(i) a pair of compression spaces each positioned between a side seam and a respective bail leg, each compression space having a width in the range of two to ten times greater than the diameter of the respective bail leg, each said bail leg being supported entirely by its connected to said bail crosspiece and a respective compression space, said bail legs forming a continuous free space therebetween uninterrupted except for said crosspiece;

(j) said side seams being spaced inwardly from said sign blank side edges;

(k) said printed subject matter comprising a weather resistant coating material; and (l) said folded sign being retained on said bail entirely by means of said engagement of said bail legs within said compression spaces and by a frictional engagement of said crosspiece adjacent to said medial fold line.

* * * * *